US007364508B2

(12) United States Patent
Loose et al.

(10) Patent No.: US 7,364,508 B2
(45) Date of Patent: Apr. 29, 2008

(54) GAMING MACHINE ENVIRONMENT HAVING CONTROLLED AUDIO AND VISUAL MEDIA PRESENTATION

(75) Inventors: Timothy C. Loose, Chicago, IL (US); Eric M. Pryzby, Skokie, IL (US); Wayne H. Rothschild, Northbrook, IL (US); Larry J. Pacey, Prospect Heights, IL (US)

(73) Assignee: WMS Gaming, Inc., Waukegan, IL (US)

( * ) Notice: Subject to any disclaimer, the term of this patent is extended or adjusted under 35 U.S.C. 154(b) by 679 days.

(21) Appl. No.: 10/342,720

(22) Filed: Jan. 16, 2003

(65) Prior Publication Data

US 2004/0142739 A1 Jul. 22, 2004

(51) Int. Cl.
*A63F 9/24* (2006.01)

(52) U.S. Cl. ..... 463/30; 463/25

(58) Field of Classification Search ..... 463/16, 463/30–31, 34–35, 42
See application file for complete search history.

(56) References Cited

U.S. PATENT DOCUMENTS

| | | | | |
|---|---|---|---|---|
| 3,533,629 | A | 10/1970 | Raven | 463/18 |
| 4,522,399 | A | 6/1985 | Nishikawa | 273/143 R |
| 5,133,017 | A | 7/1992 | Cain et al. | 381/71 |
| 5,259,613 | A | 11/1993 | Marnell, II | 273/138 |
| 5,318,298 | A | 6/1994 | Kelly et al. | 273/122 R |
| 5,370,399 | A | 12/1994 | Liverance | 273/434 |
| 5,444,786 | A | 8/1995 | Raviv | 381/71 |
| 5,469,510 | A | 11/1995 | Blind et al. | 381/55 |
| 5,524,888 | A | 6/1996 | Heidel | 43/21 |
| 5,533,727 | A | 7/1996 | DeMar | 463/23 |
| 5,542,669 | A | 8/1996 | Charron et al. | 463/13 |
| 5,655,961 | A | 8/1997 | Acres et al. | 463/27 |
| 5,695,188 | A | 12/1997 | Ishibashi | 273/143 R |
| 5,743,798 | A | 4/1998 | Adams et al. | 463/17 |

(Continued)

FOREIGN PATENT DOCUMENTS

AU 199943487 3/2000

(Continued)

OTHER PUBLICATIONS

Weint, Joe. Entertainment Vehicles, IGWB New '97 Games, Mar. 1997, pp. 11-12, 15-18.

(Continued)

*Primary Examiner*—Robert E Pezzuto
(74) *Attorney, Agent, or Firm*—Nixon Peabody, LLP.

(57) ABSTRACT

A gaming machine system comprises a game cabinet, a processor, and an audio/visual effects system. The game cabinet receives inputs and displays outputs. The processor is located within the cabinet and randomly selects a game outcome in response to a wager. The processor generates a first signal in response to a certain event occurring. The audio/visual effects system includes speakers and projecting lights, which are located remotely from the cabinet. In response to the processor generating the first signal, the audio/visual effects system broadcasts a certain audio output from the speakers toward the game cabinet and directs a certain light pattern from the projecting lights toward the game cabinet. The invention also provides for a gaming machine network with a plurality of gaming machines and an audio/visual controller. The audio/visual controller controls the audio outputs and the light patterns experienced by players of the gaming machines.

68 Claims, 5 Drawing Sheets

U.S. PATENT DOCUMENTS

| | | | | |
|---|---|---|---|---|
| 5,762,552 | A | 6/1998 | Vuong et al. | 463/25 |
| 5,775,993 | A | 7/1998 | Fentz et al. | 463/17 |
| 5,807,177 | A | 9/1998 | Takemoto et al. | 463/47 |
| 5,816,918 | A | 10/1998 | Kelly et al. | 463/16 |
| 5,828,768 | A | 10/1998 | Eatwell et al. | 381/333 |
| 5,833,538 | A | 11/1998 | Weiss | 463/21 |
| 5,851,148 | A | 12/1998 | Brune et al. | 463/25 |
| 5,941,773 | A | 8/1999 | Harlick | 463/16 |
| 5,971,850 | A | 10/1999 | Liverance | 463/23 |
| 6,056,640 | A * | 5/2000 | Schaaij | 463/4 |
| 6,068,552 | A | 5/2000 | Walker et al. | 463/21 |
| 6,089,663 | A | 7/2000 | Hill | 297/258.1 |
| 6,110,041 | A | 8/2000 | Walker et al. | 463/20 |
| 6,162,121 | A | 12/2000 | Morrow et al. | 463/16 |
| 6,217,448 | B1 | 4/2001 | Olsen | 463/25 |
| 6,254,483 | B1 | 7/2001 | Acres | 463/26 |
| 6,302,790 | B1 | 10/2001 | Brossard | 463/20 |
| 6,308,953 | B1 | 10/2001 | Nagano | 273/143 R |
| 6,315,666 | B1 | 11/2001 | Mastera et al. | 463/31 |
| 6,319,125 | B1 * | 11/2001 | Acres | 463/25 |
| 6,416,411 | B1 | 7/2002 | Tsukahara | 463/35 |
| 6,422,941 | B1 | 7/2002 | Thorner et al. | 463/30 |
| 6,471,589 | B1 | 10/2002 | Nagano | 463/21 |
| 6,530,842 | B1 | 3/2003 | Wells et al. | 463/46 |
| 6,561,908 | B1 | 5/2003 | Hoke | 463/35 |
| 6,575,829 | B2 * | 6/2003 | Coleman et al. | 463/20 |
| 6,638,169 | B2 * | 10/2003 | Wilder et al. | 463/35 |
| 6,676,514 | B1 | 1/2004 | Kusuda et al. | 463/24 |
| 6,805,633 | B2 | 10/2004 | Hein, Jr. et al. | |
| 6,843,723 | B2 * | 1/2005 | Joshi | 463/25 |
| 6,843,725 | B2 | 1/2005 | Nelson | |
| 6,848,219 | B2 * | 2/2005 | Standard et al. | 52/6 |
| 6,848,996 | B2 | 2/2005 | Hecht et al. | |
| 6,968,063 | B2 | 11/2005 | Boyd | |
| 2001/0004607 | A1 * | 6/2001 | Olsen | 463/26 |
| 2002/0037763 | A1 | 3/2002 | Idaka | 463/16 |
| 2002/0039919 | A1 | 4/2002 | Joshi et al. | 463/20 |
| 2002/0090990 | A1 | 7/2002 | Joshi et al. | 463/20 |
| 2002/0142825 | A1 | 10/2002 | Lark et al. | 463/16 |
| 2002/0142846 | A1 | 10/2002 | Paulsen | 463/43 |
| 2002/0151349 | A1 | 10/2002 | Joshi | 463/20 |
| 2003/0054881 | A1 | 3/2003 | Hedrick et al. | 463/29 |
| 2003/0064771 | A1 * | 4/2003 | Morrow et al. | 463/16 |
| 2003/0073490 | A1 | 4/2003 | Hecht et al. | |
| 2003/0073491 | A1 | 4/2003 | Hecht et al. | |
| 2003/0100359 | A1 | 5/2003 | Loose et al. | |
| 2003/0114214 | A1 | 6/2003 | Barahona et al. | 463/20 |
| 2003/0211881 | A1 | 11/2003 | Walker et al. | |
| 2003/0220139 | A1 * | 11/2003 | Peterson | 463/30 |
| 2004/0029637 | A1 | 2/2004 | Hein, Jr. et al. | 463/35 |
| 2004/0053695 | A1 | 3/2004 | Mattice et al. | |
| 2004/0082388 | A1 | 4/2004 | Simsek et al. | |
| 2004/0138889 | A1 | 7/2004 | Gilboy et al. | |
| 2004/0147316 | A1 | 7/2004 | Nagano | |

FOREIGN PATENT DOCUMENTS

| | | |
|---|---|---|
| EP | 0981 119 A2 | 2/2000 |
| JP | 5-31254 | 2/1993 |
| JP | 10-277213 | 10/1998 |
| WO | WO9858059 | 12/1998 |
| WO | WO 01/05477 A2 | 1/2001 |
| WO | WO 01/05477 A3 | 1/2001 |
| WO | WO 01/33905 A2 | 5/2001 |
| WO | WO 01/39905 A3 | 5/2001 |
| WO | WO 02/24288 A2 | 3/2002 |
| WO | WO 02/24288 A3 | 3/2002 |
| WO | WO 02/40921 A3 | 5/2002 |

OTHER PUBLICATIONS

European Search Report for European Patent Application No. EP 04 00 0865, dated Oct. 6, 2004 (3 pages).
European Search Report for European Patent Application No. EP 04 00 0730, dated Oct. 11, 2004 (5 pages).
European Search Report for European Patent Application No. EP 04 00 3314, dated Oct. 13, 2004 (3 pages).
European Search Report for European Patent Application No. EP 04 00 0731, dated Oct. 14, 2004 (3 pages).

* cited by examiner

GAMING MACHINE ENVIRONMENT HAVING CONTROLLED AUDIO AND VISUAL MEDIA PRESENTATION

RELATED APPLICATIONS

This application is being filed concurrently with U.S. patent application Ser. No. 10/342,817 entitled "Audio Network For Gaming Machines," U.S. patent application Ser. No. 10/342,809 entitled "Player-Selectable Audio Preferences For A Gaming Machine," and U.S. patent application Ser. No. 10/345,787 entitled "Gaming System With Surround Sound," all of which are assigned to the assignee of the present application and all of which are incorporated herein by reference in their entireties.

FIELD OF THE INVENTION

The present invention relates generally to gaming machines and, more particularly, to a gaming machine and a gaming machine network having enhanced audio and visual effects created by remotely located projecting lights and speakers.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Consequently, shrewd operators strive to employ the most entertaining and exciting machines available because such machines attract frequent play and, hence, increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "secondary" or "bonus" game which may be played in conjunction with a "basic" game. The bonus game may comprise any type of game, either similar to or completely different from the basic game. The bonus game is typically entered upon the occurrence of a selected event or outcome within the basic game. Such a bonus game produces a significantly higher level of player excitement than the basic game because it provides a greater expectation of winning than the basic game and is accompanied by more attractive or unusual video displays and/or audio.

Most types of enhancement, however, have focused primarily on visual effects. For example, gaming machines may included various types of displays for displaying different images in an "attract mode" to stir interest in players. And, the visual effects of the game features, such as reels and symbols, have been changed to be more attractive.

While these player-appeal features provide some enhanced excitement relative to other known games, there is a continuing need to develop new features for gaming machines to satisfy the demands of players and operators. Preferably, such new features will further enhance the level of player excitement. The present invention is directed to satisfying these needs.

SUMMARY OF THE INVENTION

In one aspect, the present invention is gaming machine system comprising a game cabinet, a processor, and an audio and visual effects system. The game cabinet receives inputs and displays outputs to a player. The processor is located within the game cabinet and randomly selects one of a plurality of outcomes in response to a wager input. The processor is configured to generate a first signal in response to the occurrence of a certain event, such as a certain game outcome being achieved. The audio and visual effects system includes speakers and projecting lights, which are located remotely from the game cabinet. In response to the processor generating the first signal, the audio and visual effects system broadcasts a certain audio output from the speakers toward the game cabinet and directs a certain light pattern from the projecting lights toward the game cabinet.

In another aspect of the invention, a gaming machine network includes a plurality of gaming machines, a plurality of speakers, a plurality of projecting lights, and an audio and visual controller. Each of the plurality of gaming machines includes a processor for randomly selecting one of a plurality of outcomes in response to a wager input. The plurality of speakers are remotely positioned from the gaming machines and produce audio outputs. The plurality of projecting lights are remotely positioned from the gaming machines and produce light patterns. The audio and visual controller is electronically coupled to (i) the plurality of gaming machines, (ii) the plurality of speakers, and (iii) the plurality of projecting lights. The audio and visual controller controls the audio outputs and the light patterns experienced by players of the gaming machines.

Alternatively, the gaming network can be a plurality of gaming terminals for receiving wagers inputs and displaying randomly selected game outcomes in response to the wager inputs. The plurality of remotely located speakers and the plurality of remotely located projecting lights are actuated in response to one of the plurality of gaming terminals achieving a certain game outcome.

The present invention also contemplates a novel method for operating a plurality of gaming machines, which are linked to a central controller. The method involves determining that a certain outcome has been achieved by one of the plurality of gaming machines. In response to this certain outcome, the central controller selectively controls an audio output from a plurality of speakers located remotely from the plurality of gaming machines. The audio output may be indicative of the certain outcome.

The present invention further contemplates a novel method that includes storing a plurality of triggering events in at least one memory device and determining whether one of the triggering events has occurred in one of the gaming machines. In response to the triggering event, the novel method creates a certain audio and visual ambience in a gaming room in which the gaming machines reside by actuating speakers and projecting lights that are remotely located from the gaming machines.

In yet another aspect, the novel method creates a certain visual ambience in the gaming room in which the gaming machines reside by actuating projecting lights that are remotely located from the gaming machines.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
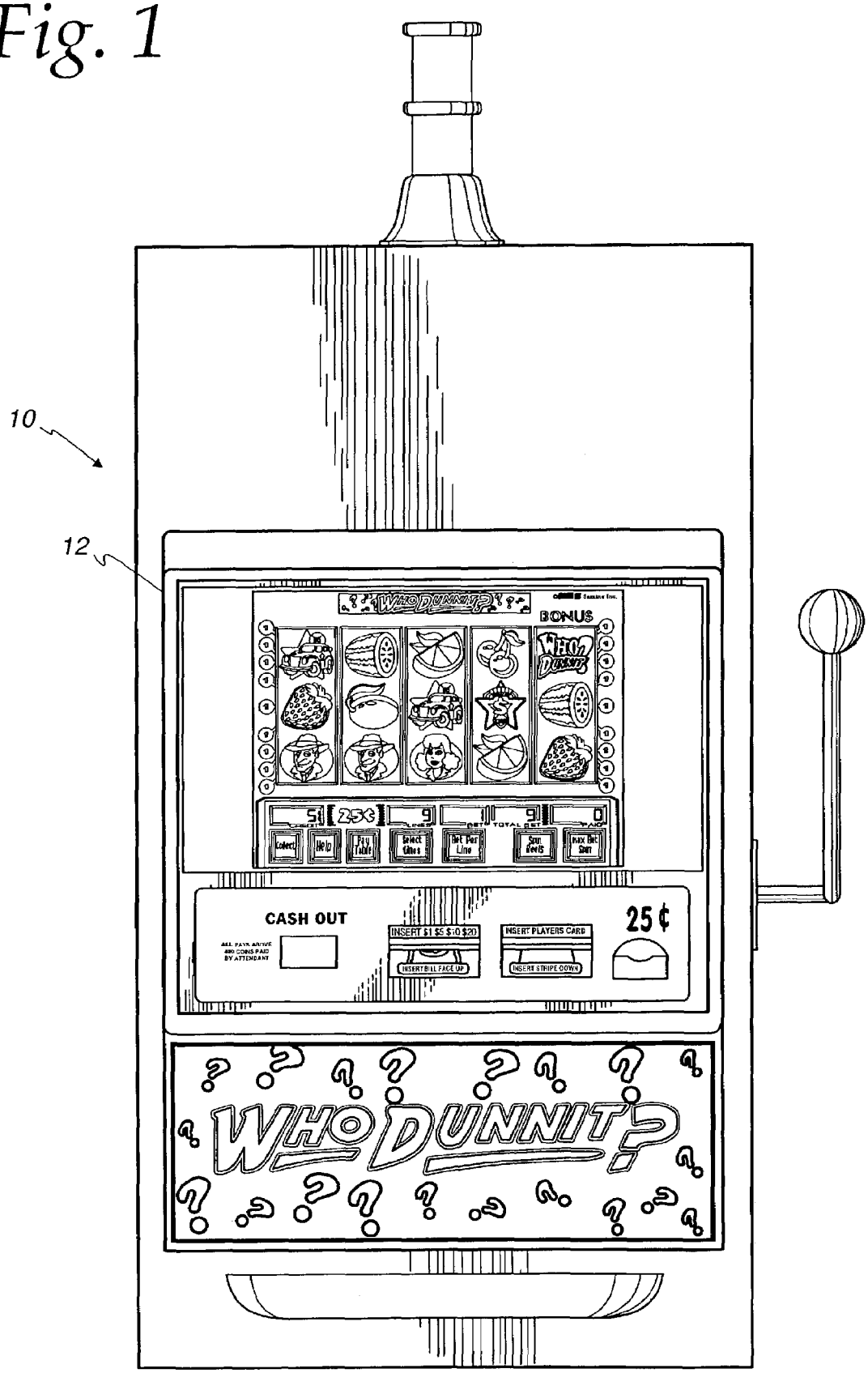
FIG. 1 is a simplified front view of a slot machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings and referring initially to FIG. 1, a video gaming machine 10 is depicted that operates a basic wagering game, which may lead to a bonus game if certain outcomes are achieved in the basic game. The gaming machine 10 includes a game cabinet having a video display 12 that may comprise a dot matrix, CRT, LED, LCD, electro-luminescent display, or generally any type of video display known in the art. In the illustrated embodiment, the gaming machine 10 is an "upright" gaming terminal in which the video display 12 includes a touch screen and is oriented vertically relative to the player. It will be appreciated, however, that any of several other models of gaming machines are within the scope of the present invention, including, for example, a "slant-top" version in which the video display is slanted at about a 30° angle toward the player, or gaming machines that include mechanical, rather than video, displays.

In one embodiment, the gaming machine 10 is operable to play a game entitled WHO DUNNIT?™ having a mystery theme. The WHO DUNNIT?™ game features a basic game in the form of a slot machine with five simulated spinning reels and a bonus game, which may include strategy options that direct game activities on the video display 12. It will be appreciated, however, that the gaming machine 10 may be implemented with games other than the WHO DUNNIT?™ game and/or with several alternative game themes.

Figure 2:
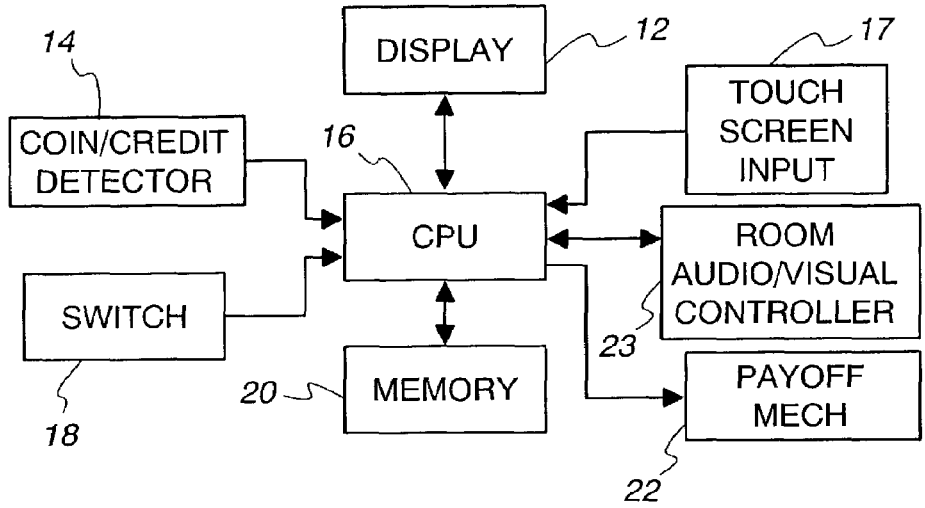
FIG. 2 is a block diagram of a control system suitable for operating the gaming machine in FIG. 1.

FIG. 2 is a block diagram of a control system suitable for operating the gaming machine 10. Coin/credit detector 14 signals a CPU 16 when a player has inserted a number of coins or played a number of credits. Then, the CPU 16 executes a game program which causes the video display 12 to display the basic game that includes simulated reels with symbols displayed thereon. The player may select a number of paylines to play, as is known in the art, and the wager amount may be entered via touch screen input keys 17 or other input devices on the game cabinet. The basic game commences in response to the player activating a switch 18, which is a lever or push button, causing the CPU 16 to set the reels in motion, randomly select a game outcome, and then stop the reels to display symbols corresponding to the pre-selected game outcome. In one embodiment, certain basic game outcomes cause the CPU 16 to enter a bonus mode, which causes the video display 12 to show a bonus game, as is known in the art.

A system memory 20 stores control software, operational instructions, and data associated with the gaming machine 10. In one embodiment, the system memory 20 comprises a separate read-only memory (ROM) and battery-backed random-access memory (RAM). It will be appreciated, however, that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes, which may occur in the basic game or bonus game. The payoff amounts corresponding to certain combinations of symbols in the basic game are predetermined according to a pay table stored in system memory 20. The payoff amounts corresponding to certain outcomes of the bonus game are also stored in system memory 20.

As shown in FIG. 2, the CPU 16 for the gaming machine 10 is coupled to a gaming room audio/visual controller 23 (hereinafter "the A/V controller"). The A/V controller 23 is used for controlling the audio and visual effects in the gaming room in which the gaming machine 10 resides. As will be described below in more detail, the A/V controller 23 is coupled to a plurality of speakers and a plurality of projecting lights, and actuates those components in response to certain triggering events occurring in the gaming machine 10. The triggering events may be the entering of a bonus game, achieving a certain monetary win, a randomly selected time, or a randomly selected event such as a random number of pulls of a slot arm on a slot machine. The A/V controller 23 may be located internal to the gaming machine 10, may be part of a central gaming controller in the casino, or may be an application-specific controller that is linked and external to a plurality of game machines 10. This latter configuration is illustrated in FIG. 3.

In one basic system configuration, the gaming machine 10 stores data related to the audio and visual effects (hereinafter "A/V data") in the memory 20. The CPU 16, in response to a certain triggering event, then retrieves the A/V data from memory 20 and sends the A/V data to the A/V controller 23. The A/V controller 23 then actuates the speakers and projecting lights in accordance with the A/V data. Preferably, the audio data within the A/V data is in a digital format. As such, the A/V controller 23 must include components and circuitry for converting the digital audio data to analog audio signals, and amplifying those analog signals to produce an output from the speakers. In one preferred embodiment, the audio data is stored in a surround-sound format for broadcasting a surround-sound audio output from a plurality of speakers 23 spatially arranged around the gaming machine 10.

Figure 4:
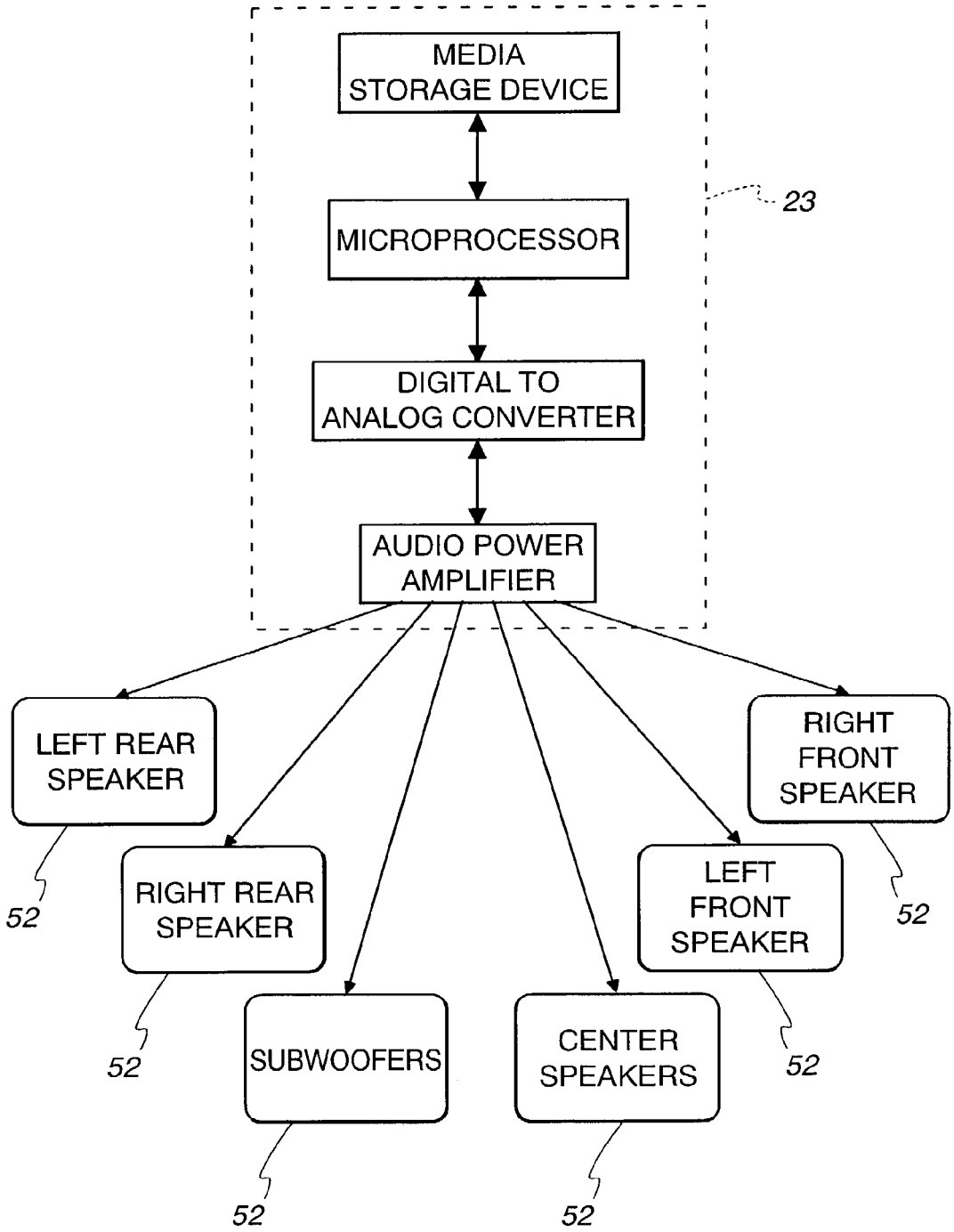
FIG. 4 illustrates a flow chart that schematically illustrates the processing of audio signals.

Rather than storing the A/V data in the gaming machines 10, other system configurations can be utilized as well so as to achieve enhanced audio and visual effects for a player of the gaming machine 10. For example, the A/V data can be stored within a memory device directly coupled to the A/V controller 23, as is shown in FIG. 4 in which the memory storage device is within the A/V controller 23. In such an embodiment, the memory device may only store A/V data. In this system configuration, the CPU 16 simply needs to transmit a signal to the A/V controller 23 indicating which triggering event has occurred, and the A/V controller 23 selects the corresponding A/V data for that triggering event. This system configuration allows for a more sophisticated audio and visual experience without overburdening the CPU 16 and the memory 20 of the gaming machine 10.

Figure 3:
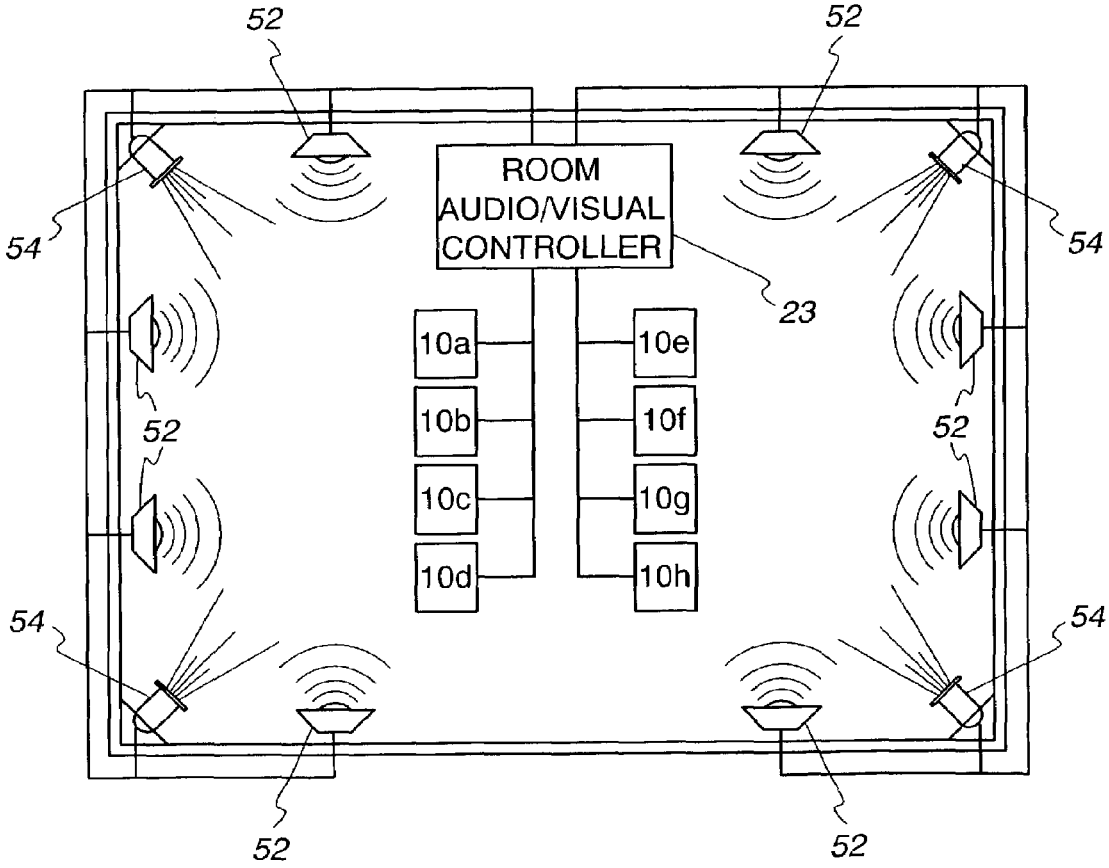
FIG. 3 illustrates a schematic of one embodiment of the present invention in which a bank of gaming machines resides in a gaming room providing enhanced audio and visual effects.

Referring now to FIG. 3, a gaming room 50 includes a plurality of gaming machines 10*a*-10*h*. The gaming machines 10*a*-10*h* may offer the same game, but may also present different games for players. Even if different games are present, the is different games being played on the gaming machines 10*a*-10*h* may all have the same theme, such as a game-show theme or a sports theme.

The gaming room 50 includes a plurality of speakers 52 that are remotely placed around the gaming machines 10*a*-10*h*. Further, a plurality of projecting lights 54 are remotely located around the gaming machines 10*a*-10*h*. In this configuration, the gaming machines 10*a*-10*h* are coupled to the A/V controller 23, which is remotely located from the gaming machines 10*a*-10*h*. The A/V controller 23 is further coupled to the speakers 52 and the projecting lights 54. Based on the triggering signals received from the gaming machines 10*a*-10*h*, the A/V controller 23 selectively controls the audio output from the speakers 52 and the light patterns from the projecting lights 54. Preferably, the speakers 52 and projecting lights 54 are arranged so that regardless of which gaming machine achieves a certain triggering event, the player of that gaming machine experiences audio outputs and lighting patterns that are substantially similar to audio outputs and lighting patterns that would be experienced if the player encountered the same triggering event at a different gaming machine.

It should be noted that the present invention contemplates a gaming machine system having a multitude of differing audio and visual effects, each being dictated by a certain triggering event. Further, in some situations, only certain speakers 52 and projecting lights 54 are actuated such that the audio and visual effects may be directed to only gaming machines 10*a*-10*d*, while players at the gaming machines 10*e*-10*h* do not experience the full audio and visual ambience.

The speakers 52 broadcast audio output to the players of the gaming machines 10*a*-10*h*, as well as spectators adjacent to the gaming machine 10. The audio output may include various outputs, such as messages related to the gaming machines 10*a*-10*h* being played (e.g., informational or instructional content), messages unrelated to the gaming machines 10*a*-10*h*, a certain type of music (e.g., rock, classical, jazz, etc.), or music related to a theme of a game being played on one or more of the gaming machines 10*a*-10*h*. Preferably, the relative orientation of the speakers 52 and the gaming machines 10*a*-10*h* allows the speakers 52 to deliver surround sound to the players of the gaming machines 10*a*-10*h*. Also, if different gaming machines 10*a*-10*h* with different themes are grouped together, then the speakers 52 preferably are capable of delivering audio outputs corresponding to the different themes.

Also, the speakers 52 may work in conjunction with the typical speakers that are mounted with the gaming machines 10*a*-10*h* to deliver enhanced effects. For example, while playing a gaming machine with a game-show theme, the gaming machine speakers may instruct the player, "OK, you now need to choose a prize from behind door number 1, door number 2, or door number 3." After making the selection and achieving a positive result, the remote speakers 52 can deliver an audio output that makes the player feel as though he or she is in a virtual studio audience where the audience is clapping. The projecting light 54 may also focus a light pattern on the player at this point as well. Then, the gaming machine speakers may instruct the player, "The audience really loved that choice!"

In one preferred embodiment, the speakers 52 deliver focused audio output to only certain regions of the gaming room 50 (audio 3D). Accordingly, in addition to the projecting lights 54 being able to focus the light pattern on one gaming machine, the speakers 52 can focus the audio output on one gaming machine as well.

The projecting lights 54 are preferably luminaires, which are complete lighting units capable of delivering focused light to a certain area, as is commonly used in concerts and theaters. Luminaires have their own internal control mechanisms for various photometrics, such as colors, beam divergence, intensity, strobing, etc. Preferably, the luminaires used in the gaming room 50 have motors for changing the position of the beam (e.g., from the first gaming machine 10*a* in a bank, to the last gaming machine 10*d* in the bank) and the beam divergence (e.g., beams where the angle of divergence changes over a short period of time). As such, luminaires provide for dynamic control of the beams in the gaming room 50. Example of luminaires useful for the gaming room 50 are manufactured and sold by Vari-Lite Inc. of Dallas, Tex.

Alternatively, the projecting lights 54 may also be fixed lights providing focused beams to only certain parts of the gaming room 50. As an example, each gaming machine 10*a*-10*h* may have a set of fixed lights that are remotely located therefrom, and capable of delivering light to only that gaming machine 10*a*-10*h*.

FIG. 4 illustrates one method of the processing of audio signals within the audio and visual effects system of the present invention. Here, the A/V controller 23 includes a media storage device to store the A/V data, which includes digital audio data. A microcontroller or microprocessor within the A/V controller 23 receives the digital audio data and sends it to a D/A converter. The analog signals leaving the D/A converter are amplified and the amplified analog signals are then sent to the various speakers 52 throughout the gaming room. If the gaming room 50 (FIG. 3) only requires a certain audio output in one region, the audio data may have some location data to ensure that the audio output is broadcast in the desired region, likely by actuating only certain ones of the speakers 52.

FIG. 4 illustrates a set of speakers 52 that can provide a surround-sound audio experience. The speakers 52 include rear left speakers, rear right speakers, front left speakers, front right speakers, center speakers, and subwoofers. The various formats for the audio data sets that can be used by the embodiments of the present invention for delivering surround sound are described in detail in U.S. patent application Ser. No. 10/345,787 entitled "Gaming System With Surround Sound" (filed on the same day as the present application, having common inventors as the present application, and being owned by the assignee of the present application), which is herein incorporated by reference in its entirety.

In a similar fashion to FIG. 4, the control of the projecting lights 54 is dictated by the A/V data stored in the media storage device of the A/V controller 23. The type of visual control data that is to be transmitted from the microprocessor to the projecting lights 54 depends on the type of projecting lights 54. If the projecting lights 54 have motors to steer their beams, the visual control data needs to have some location data to ensure the light patterns are created at the appropriate location in the gaming room 50. Preferably, the data is digital and is sent in a digital format to the projecting lights 54, which is then processed by local controllers in the projecting lights 54 for developing the selected light pattern. As such, the D/A converter and amplifier in FIG. 4 may not be needed for the visual control data sent to the projecting lights 54.

In short, in the preferred embodiment, the media storage device in the A/V controller 23 stores the various light patterns that can be selected and sends "high-level" instructions to the projecting lights 54 corresponding to the selected light pattern. The local controllers at the projecting lights 54 then converts the "high-level" instructions to "low-level" instructions, which are internally used by the projecting lights 54 to control internal components such as lenses, motors, power supplies, etc., to result in the desired light pattern corresponding to the triggering event. As an example, "high-level" instructions may be to focus a red beam on gaming machine 10*a*. The corresponding "low-level" instructions would be for the motor to adjust the location of the beam to coordinates x, y, z, (where gaming machine 10*a* is located) and for switching the color filter to one that will result in a red light. To achieve this type of control, the A/V controller 23 may employ lighting control hardware and software for communicating with the projecting lights 54. This lighting control hardware and software is commonly available from manufacturers of luminaires, such as Vari-Lite, Inc. of Dallas, Tex.

It should be noted that the present invention contemplates that the A/V controller 23 may comprise two distinct controllers, one for controlling the audio output and one for controlling the light patterns. The two distinct controllers may be remotely located from each other. Each would receive signals identifying the occurrence of certain triggering events.

Figure 5:
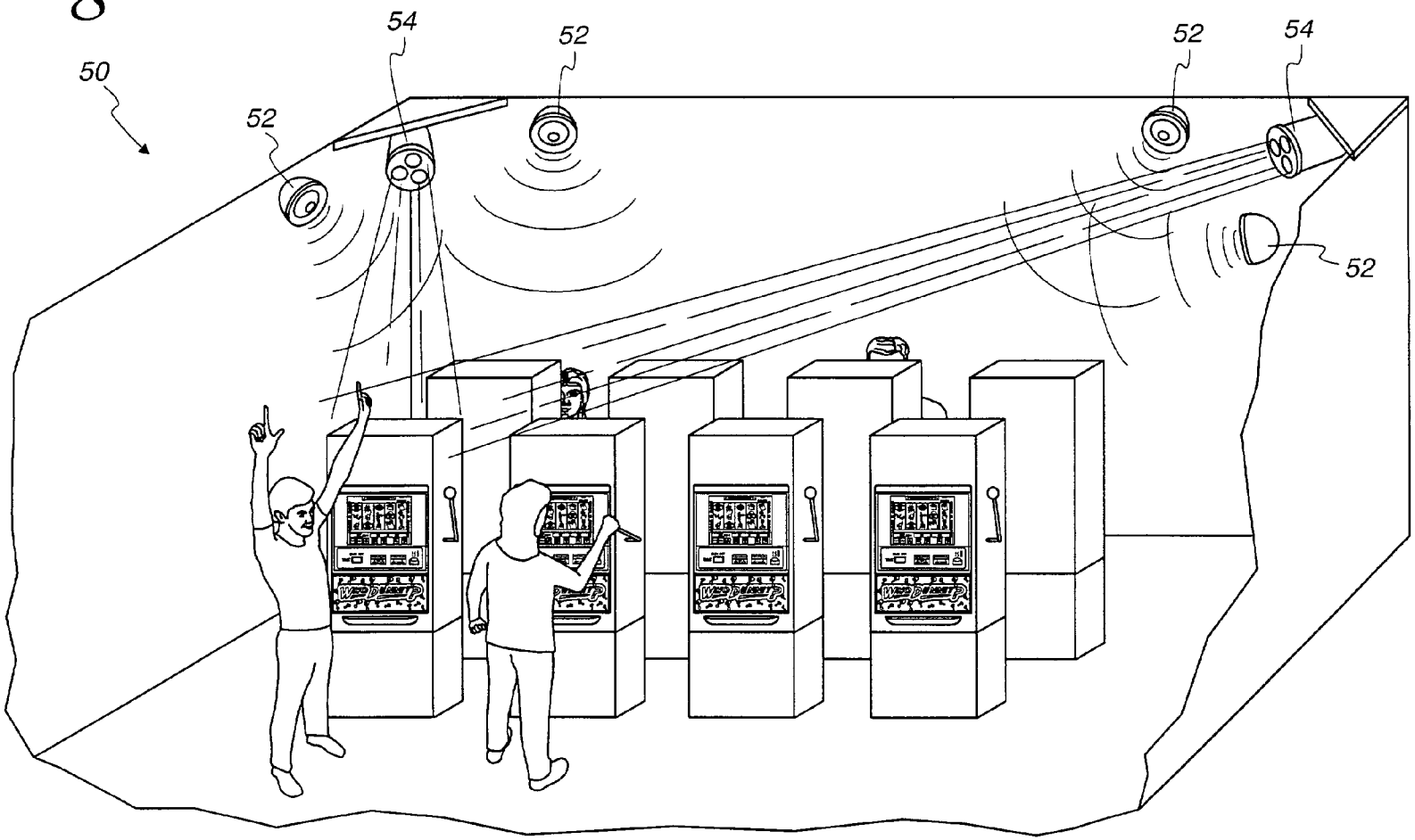
FIG. 5 illustrates a gaming room according to one embodiment of the present invention in which one gaming machine has achieved a certain outcome, causing enhanced audio and visual effects to be presented to the gaming room.

FIG. 5 illustrates one type of result that can be achieved by the audio and visual effects system in a gaming room 50 having remotely located speakers and remotely located projecting lights 54 in accordance to the present invention. In this embodiment, the triggering event for the enhanced visual and audio ambience is achieving a certain game outcome at one of the gaming machines 10. In response to this triggering event, the A/V controller 23 (not shown in FIG. 5) receives a signal from the gaming machine 10 that indicates that it has achieved this certain game outcome (e.g., the entry into a bonus game mode). The A/V controller 23 would then cause the actuation of the projecting lights 54 and speakers 52 to result in a certain audio output and light pattern. As shown, some of the projecting lights 54 in the gaming room have focused their beams on the wining gaming machine. Alternatively, knowing the location where the player would stand or sit relative to the gaming machine 10, the projecting lights 54 may focus their beams at that location where the player would normally be standing or sitting.

There is a wide variety of audio output that can be broadcast from the speakers 52. If the gaming machine has a game-show theme, the audio output may simply be sounds simulating an excited studio audience from a game-show. When coupled with the focused light patterns, the player may feel that he or she is totally emersed in a game-show environment. Or, the audio output may be music that is indicative of the game outcome, such as the song "We Are The Champions" by the musical group Queen. Still further, music lacking lyrics, but which is fast and upbeat, could be broadcast from the speakers 52 to indicate a positive game outcome. The focused audio output defines, in essence, a sound stage for the player of the gaming machine.

In short, the enhanced visual and audio ambience in the gaming room 50 of the present invention further enhances the level of player excitement. Players not typically desiring to play these types of games are much more likely to be intrigued by the gaming machine, resulting in a larger market of players for gaming machines providing these enhanced audio and visual effects. Further, because some players may not enjoy being the focal point of attention, the gaming machines may have inputs that allow the players to avoid the enhanced audio and visual experience after he or she achieves a certain outcome.

Figure 6:
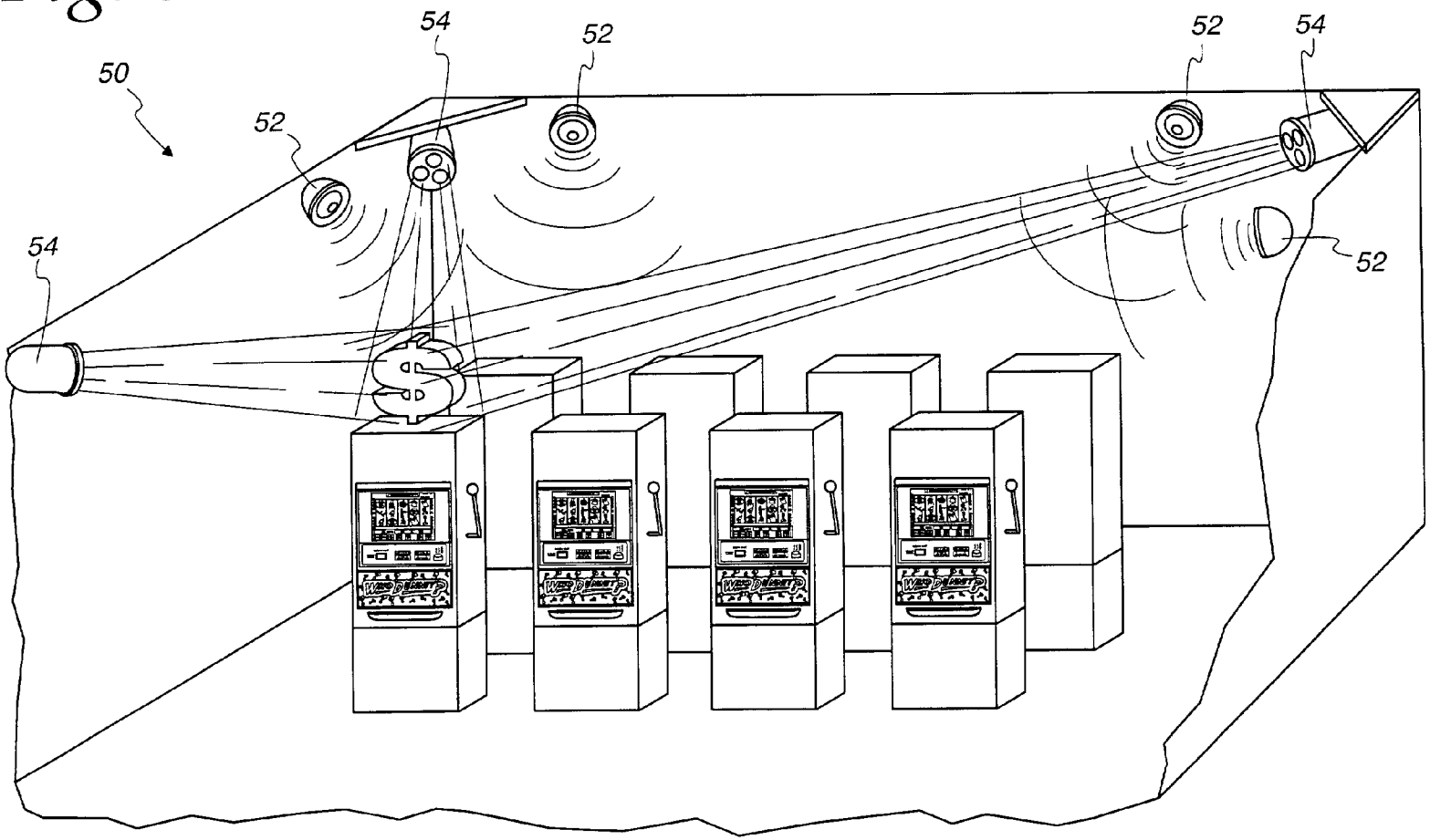
FIG. 6 illustrates a gaming room according to another embodiment of the present invention where an attract mode with enhanced audio and visual effects are presented to the gaming room.

FIG. 6 is similar to FIG. 5 as it illustrates the gaming room 50 with the speakers 52 and the projecting lights 54. However, the triggering event is inactivity of one or more gaming machines over a certain period of time, causing the system to operate in an "attract mode" to stir interest from players in the vicinity of the gaming machines. As such, one or more of the gaming machines sends a signal indicating inactivity after a predefined period of time. In the attract mode, the light pattern could be the focusing of beams on an inactive machine, and it may be accompanied by an audio output that may state "This machine wants to give away money!! Who wants the money?"

Alternatively, and as shown in FIG. 6, the gaming room 50 may have objects positioned above the gaming machines that allow for the display of images above the gaming machines. As an example, the object can be relatively transparent so that it is generally unnoticed by the players of the gaming machines. Such an object may be a thin layer of plastic or other target material capable of displaying an image. Instead, of simply directing light beams, the projecting lights 54 project focused images that are displayed on the object above the gaming machine. As shown in FIG. 6, the recognizable image is a dollar sign.

Alternatively, the projecting lights 54 may be of a type that provides a floating, volume-filling image that has substantial 3-dimensional qualities (e.g., an autostereoscopic image). For example, such an image may be of a gaming machine that has a highly desirable game outcome on its display, perhaps leading players to believe that the actual gaming machine below this 3D image may soon yield such an outcome. To produce such images, more sophisticated projecting lights 54 are needed, as well as a rotating display for the image. Such systems are available from Actuality Systems, Inc. of Burlington, Mass.

While the present invention has been described with reference to one or more particular embodiments, those skilled in the art will recognize that many changes may be made thereto without departing from the spirit and scope of the present invention. As one example, the gaming machine network may provide only enhanced audio output from the remotely located speakers. Or, the gaming machine network may provide only enhanced visual output from the remotely located projecting lights. Further, the present invention is also useful for wagering games where the CPU 16 (FIG. 2) and/or memory 20 (FIG. 2) are located remotely from a gaming terminal with the input/output devices that receive wagering inputs and other instructions from the player and display the randomly selected outcome to the player. Each of these embodiments and obvious variations thereof is contemplated as falling within the spirit and scope of the claimed invention, which is set forth in the following claims.

What is claimed is:

1. A gaming machine system, comprising:

a game cabinet for receiving inputs and displaying outputs to a player;

a processor located within said cabinet for randomly selecting one of a plurality of outcomes in response to a wager input, said processor generating a first signal in response to a certain event; and an audio and visual effects system located remotely from said game cabinet and including speakers and projecting lights, said audio and visual effects system, in response to said processor generating said first signal, broadcasting a certain audio output from said speakers toward said game cabinet and directing a certain light pattern from said projecting lights toward said game cabinet, said certain audio output and said certain light pattern being focused on said game cabinet, but not adjacent game cabinets, to provide a specific audio-visual experience to the player at said game cabinet.

2. The gaming machine system of claim 1, wherein said projecting lights include motors for controlling the location of said light pattern relative to said game cabinet.

3. The gaming machine system of claim 1, wherein said audio and visual effects system includes a controller external to said game cabinet, said processor transmits said first signal to said external controller, said external controller controlling said speakers and said projecting lights in response to receiving said first signal.

4. The gaming machine system of claim 3, wherein said external controller is coupled to a plurality of gaming machines.

5. The gaming machine system of claim 1, wherein said audio and visual effects system includes a controller that is internal to said game cabinet, said processor transmits said first signal to said internal controller, said internal controller controlling said speakers and said projecting lights in response to receiving said first signal.

6. The gaming machine system of claim 1, wherein said gaming cabinet has a theme, said certain audio output from said speakers corresponding to said theme.

7. The gaming machine system of claim 6, wherein said theme is a game show and said audio output simulates a studio audience environment.

8. The gaming machine system of claim 7, wherein said speakers provide said audio output in a surround-sound format.

9. The gaming machine system of claim 1, wherein said speakers provide said audio output in a surround-sound format.

10. The gaming machine system of claim 1, wherein said processor generates a second signal in response to a second event, said audio and visual effects system, in response to said processor generating said second signal, broadcasting a second audio output from said speakers toward said game cabinet and directing a second light pattern from said projecting lights toward said game cabinet.

11. The gaming machine system of claim 1, wherein said gaming cabinet includes internal speakers that operate in conjunction with said remotely located speakers to produce said audio output.

12. The gaming machine system of claim 1, wherein said certain event is a period of inactivity, causing said audio and visual effects system to operate in an attract mode.

13. The gaming machine system of claim 1, wherein said light pattern produces a recognizable image.

14. The gaming machine system of claim 13, wherein said recognizable image is an image commonly associated with money.

15. The gaming machine system of claim 13, wherein said recognizable image is directly adjacent to said gaming cabinet.

16. The gaming machine system of claim 1, wherein said certain event is a desired outcome of said plurality of outcomes.

17. The gaming machine system of claim 16, wherein said desired outcome is the playing of a bonus game.

18. A gaming machine network, comprising:

a plurality of gaming machines, each of said plurality of gaming machines including a processor for randomly selecting one of a plurality of outcomes in response to a wager input;

a plurality of speakers remotely positioned from said gaming machines and for producing audio outputs;

a plurality of projecting lights remotely positioned from said gaming machines and for producing light patterns; and an audio and visual controller electronically coupled to said plurality of gaming machines, said plurality of speakers, and said plurality of projecting lights, said audio and visual controller for selectively controlling said audio outputs and said light patterns experienced by players of said gaming machines, said audio and visual controller actuating said speakers and said projecting lights to produce a certain focused audio-visual effect at a first one of said gaming machines in response to a desired one of said plurality of outcomes occurring at said first one of said gaming machines.

19. The gaming machine network of claim 18, wherein said plurality of speakers is arranged to produce said audio output in a surround-sound format.

20. The gaming machine network of claim 18, wherein said audio and visual controller selectively controls said audio outputs and said light patterns so that only one of said audio outputs and said light patterns is actuated at one time.

21. The gaming machine network of claim 18, wherein said audio and visual controller controls said audio outputs and said light patterns in an attract mode in response to a period of inactivity in one or more of said plurality of gaming machines.

22. The gaming machine network of claim 18, wherein said first one of said plurality of gaming machines sends a signal to said audio and visual controller in response to the occurrence of said desired outcome of said plurality of outcomes.

23. The gaming machine network of claim 22, wherein said desired outcome is the playing of a bonus game on said one of said plurality of gaming machines.

24. The gaming machine network of claim 22, wherein said audio and visual controller simultaneously actuates said speakers and said projecting lights to produce said certain focused audio-visual effect.

25. The gaming machine network of claim 18, wherein said plurality of gaming machines are positioned at known locations in a gaming room, said plurality of speakers and said plurality of projecting lights are located at selected positions within said gaming room so as to be able to provide substantially similar audio outputs and light patterns to players at each of said plurality of gaming machines.

26. The gaming machine network of claim 18, wherein said audio output includes informational or instructional content related to said gaming machines.

27. The gaming machine network of claim 18, wherein each of said plurality of gaming machines has a similar theme, said audio output being indicative of said similar theme.

28. The gaming machine network of claim 27, wherein said audio and visual controller has two control processors, one of said two control processors for controlling said light pattern and the other of said two control processors for controlling said audio output.

29. The gaming machine network of claim 18, wherein said plurality of gaming machines includes gaming machines with different themes, said audio and visual controller capable of delivering different audio output corresponding to said different themes.

30. The gaming machine network of claim 18, wherein said audio and visual controller includes a digital-to-analog converter and a power amplifier for processing audio data to broadcast said audio output from said plurality of speakers.

31. The gaming machine network of claim 30, wherein each of said plurality of gaming machines includes a memory device for storing audio data for producing said audio output, said audio and visual controller capable of receiving said audio data from each of said plurality of gaming machines.

32. A gaming network, comprising:

a plurality of gaming terminals for receiving wagers inputs and displaying randomly selected game outcomes in response to said wager inputs each gaming terminal having a local speaker system;

a plurality of remote speakers remotely positioned from said gaming terminals, said plurality of remote speakers for producing audio outputs and being coupled to said plurality of gaming terminals; and a plurality of projecting lights remotely positioned from said gaming terminals, said plurality of projecting lights for producing light patterns and being coupled to said plurality of gaming terminals; and wherein said plurality of remote speakers and said plurality of projecting lights are actuated in response to one of said plurality of gaming terminals achieving a certain game outcome and, together with said local speaker system for said one of said plurality of gaming terminals, produce a focused audio-visual effect for a player at said one of said plurality of gaming terminals.

33. The gaming network of claim 32, wherein said audio output is in a surround-sound format.

34. The gaming network of claim 32, wherein said gaming terminals include a processor for randomly selecting said game outcomes in response to said wager inputs.

35. The gaming network of claim 32, wherein said audio output is selected to be different based on different ones of said certain game outcomes.

36. The gaming network of claim 32, further including a controller interconnected to said plurality of gaming terminals, said controller for controlling the actuation of said plurality of lights and said plurality of speakers.

37. The gaming network of claim 36, wherein said controller stores audio data for producing said audio output.

38. The gaming network of claim 37, wherein said plurality of gaming terminals includes games with different themes, said stored audio data corresponding to said different themes.

39. A method of operating a plurality of gaming machines, each of which is linked to a central controller, said method comprising:

determining that a certain triggering event has occurred at one of said plurality of gaming machines; and in response to said certain triggering event, (i) selectively controlling, via said central controller, an audio output from a plurality of speakers located remotely from said plurality of gaming machines and (ii) selectively controlling at least one projecting light located remotely from said plurality of gaming machines to produce a light pattern focused on said one of said plurality of gaming machines;

wherein said selectively controlling of said audio output includes actuation of only certain ones of said plurality of speakers to direct said audio output to less than all of said plurality of gaming machines.

40. The method of claim 39, wherein said controlling of said at least one projecting light includes transmitting location data of said one of said plurality of gaming machines to said at least one projecting light.

41. The method of claim 39, wherein said at least one projecting light includes flashing lights projected toward said one of said plurality of gaming machines.

42. The method of claim 39, wherein said at least one projecting light produces diverging beams with the angle of divergence changing over a short period of time and generally focusing on said one of said plurality of gaming machines.

43. The method of claim 39, wherein said light pattern produces a recognizable image.

44. The method of claim 43, wherein said recognizable image is an image commonly associated with money.

45. The method of claim 44, wherein said recognizable image is a dollar sign.

46. The method of claim 43, wherein said recognizable image is directly adjacent to said one of said plurality of gaming machines.

47. The method of claim 39, wherein said light pattern is controlled via said central controller.

48. The method of claim 47, wherein said at least one projecting light includes a local controller coupled to internal components in said at least one projecting light for controlling characteristics of said light pattern, said central controller transmitting high level instructions to said local controller, said local controller developing low level instructions for controlling said internal components.

49. The method of claim 39, wherein said controlling includes moving said light pattern under the power of a motor coupled to said projecting light.

50. The method of claim 39, wherein said certain triggering event is a certain outcome, said audio output contains a message for a player of said one of said plurality of gaming machines.

51. The method of claim 50, wherein said message relates to said certain outcome achieved by said game.

52. The method of claim 51, wherein said message includes music having lyrics that relate to said certain outcome.

53. The method of claim 39, wherein said plurality of speakers are positioned at locations around said plurality of gaming machines.

54. The method of claim 53, wherein said audio output is in a surround-sound format.

55. The method of claim 39, wherein central controller is located remotely from said plurality of gaming machines.

56. A method of operating a plurality of gaming machines residing in a gaming room, comprising:

storing a plurality of triggering events in at least one memory device;

determining whether one of said triggering events has occurred at a first one of said plurality of gaming machines, said triggering event including a certain outcome in said first one of said plurality of gaming machines; and in response to said triggering event, creating a certain audio and visual ambience in said gaming room by actuating speakers and projecting lights that are remotely located from said plurality of gaming machines, said audio and visual ambience being focused toward said first one of said plurality of gaming machines to provide an enhanced experience to the player at said first one of said plurality of gaming machines.

57. The method of claim 56, wherein said certain outcome is a playing of a bonus game.

58. The method of claim 56, wherein said player of said one of said plurality of gaming machines can provide an input that avoids said enhanced experience being focused on said one of said plurality of gaming machines.

59. The method of claim 56, wherein said plurality of gaming machines have a similar theme, said audio and visual ambience being indicative of said theme.

60. The method of claim 56, wherein each of said plurality of gaming machines includes said memory device, said step of determining occurring at said gaming machines.

61. The method of claim 56, wherein said certain audio and visual ambience includes a surround-sound audio format.

62. The method of claim 56, wherein said triggering event is a period of inactivity in one or more of said plurality of gaming machines.

63. The method of claim 56, wherein said certain audio and visual ambience includes recognizable images.

64. The method of claim 63, wherein one of said recognizable images is an image commonly associated with money.

65. The method of claim 63, wherein certain audio and visual ambience is experienced by less than all of said plurality of gaming machines.

66. A method of operating a plurality of gaming machines residing in a gaming room, comprising:

storing a plurality of triggering events in at least one memory device, said triggering events including a desired game outcome;

determining whether one of said triggering events has occurred in said gaming machines; and in response to said triggering event, creating a certain visual ambience in said gaming room by actuating projecting lights that are remotely located from said plurality of gaming machines, said certain visual ambience being focused on one of said plurality of gaming machines.

67. The method of claim 66, wherein said creating includes moving said light patterns under the power of motor coupled to said projecting lights.

68. The method of claim 53, wherein said selectively controlling includes actuation of only certain ones of said plurality of speakers to direct said audio output to less than all of said plurality of gaming machines.

* * * * *